US005576817A

United States Patent [19]

Gibson et al.

[11] Patent Number: 5,576,817

[45] Date of Patent: Nov. 19, 1996

[54] DUAL ZONE DEVELOPMENT FOR LIQUID DEVELOPERS

[75] Inventors: George A. Gibson, Fairport; Edward B. Caruthers, Rochester; Inan Chen, Webster, all of N.Y.

[73] Assignee: Xerox Corporation, Stamford, Conn.

[21] Appl. No.: 475,279

[22] Filed: Jun. 7, 1995

[51] Int. Cl.[6] ..... G03G 15/06

[52] U.S. Cl. ..... 355/262; 355/256

[58] Field of Search ..... 355/262, 265, 355/257, 256, 261; 430/32

[56] References Cited

U.S. PATENT DOCUMENTS

Re. 30,535 3/1981 Kuroishi et al. ..... 355/262

Re. 31,964 8/1985 Schaefer et al. ..... 355/262

4,768,060 8/1988 Landa et al. .

5,012,300 4/1991 Levanon et al. ..... 355/328

*Primary Examiner*—R. L. Moses

*Attorney, Agent, or Firm*—Lloyd F. Bean, II

[57] ABSTRACT

An apparatus for developing an image on an imageable surface with liquid developer including a housing having a chamber defined therein for holding liquid developer. A pump is provided for advancing liquid developer from the chamber of the housing to a development zone. An electrode member is provided having at least two segments electrically separated from each other by a insulating layer. The electrode member is positioned opposed from the imageable surface at a predefined distance forming the development zone therebetween. A power supply is provided for applying a electrical potential to the electrode member.

16 Claims, 2 Drawing Sheets

DUAL ZONE DEVELOPMENT FOR LIQUID DEVELOPERS

FIELD OF THE INVENTION

This invention relates generally to an electrophotographic printing machine, and, more particularly, concerns a developer apparatus for liquid developer having a dual development zone.

BACKGROUND OF THE INVENTION

The present invention is employed in a printing machine which employs the basic reprographic process used in an electrostatographic printing machine which generally involves an initial step of charging a photoconductive member to a substantially uniform potential. The charged surface of the photoconductive member is thereafter exposed with light in an imagewise manner to selectively dissipate the charge thereon in selected areas irradiated by the light image. This procedure records an electrostatic latent image on the photoconductive member corresponding to the informational areas contained within the original document being reproduced. In a printing machine using liquid electrophoretic developer the latent image is then developed by bringing a liquid developer material including toner particles which pass by electrophoresis into contact with the latent image. The toner particles form a toner image on the photoconductive member which toned image is subsequently transferred to a copy sheet.

It is highly desirable to increase the process speed and to reduce the size of a developer apparatus. This would enable a more compact and higher copy output printing machine.

SUMMARY OF THE INVENTION

In accordance with one aspect of the present invention, there is provided an apparatus for developing an image on an imageable surface with liquid developer including a housing having a chamber defined therein for holding a supply of liquid developer; a pump for advancing liquid developer from the chamber of the housing to a development zone; an electrode member positioned opposit the imageable surface at a predefined distance forming the development zone therebetween.; at least two segments of the electrode member, electrically separated from each other by a insulating layer; a power supply for applying different electrical potentials to the segments of the electrode member.

DESCRIPTION OF THE DRAWINGS

Other aspects of the present invention will become apparent as the following description proceeds and upon reference to the drawings, in which.

While the present invention will be described in connection with a preferred embodiment and method of use thereof, it will be understood that it is not intended to limit the invention to that embodiment or method of use. On the contrary, it is intended to cover all alternatives, modifications and equivalents that may be included within the spirit and scope of the invention as defined by the appended claims.

DETAILED DESCRIPTION OF THE INVENTION

Figure 1:
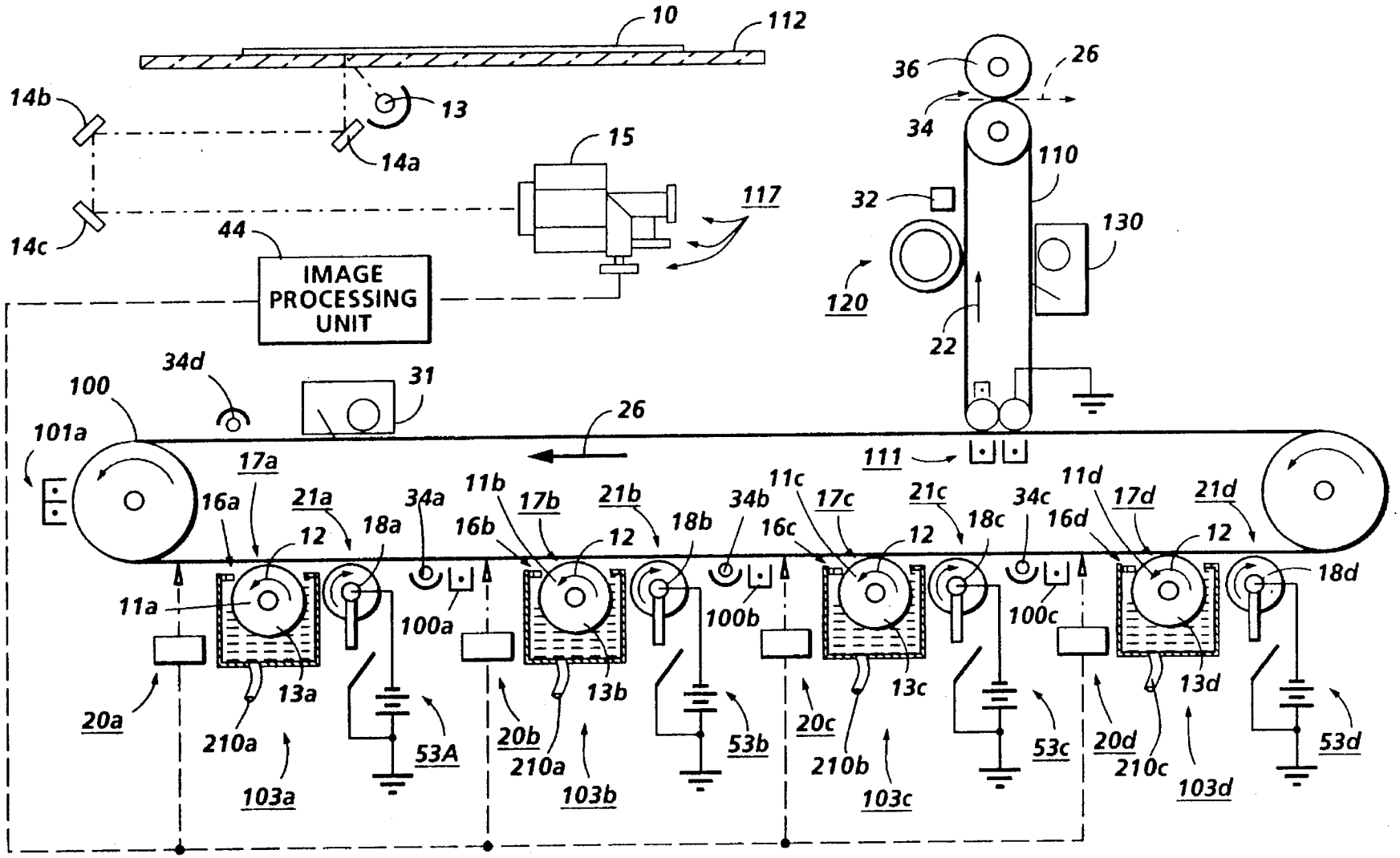
FIG. 1 is a schematic, elevational view of a color electrophotographic printing machine that incorporates the present invention therein.

For a general understanding of the features of the present invention, reference numerals have been used throughout to designate identical elements. FIG. 1 schematically depicts the various elements of an illustrative color electrophotographic printing machine incorporating the present invention therein. It will become evident from the following discussion that the present invention is equally well suited for use in a wide variety of printing machines and is not necessarily limited in its application to the particular embodiment depicted herein. Further examples of the use of this invention are: This invention can be used with either positively or negatively charged toner particles. In addition to the electrophotographic example provided below, this invention can be used in an ionographic print engine, either to develop the image onto the final substrate or to develop the image onto a first dielectric layer from which said image would subsequently be transferred to the final substrate. In addition to the four color electrophotographic example provided below, this invention can be used in a single color printer, or in a printer with black and spot colors, or in a printer with four process colors and additional custom colors (metallic, varnish, etc.). In addition to the electrophotographic example provided below, this invention can be used in a printer with multiple photoreceptors for the multiple colors. In addition to the electrophotographic example provided below, this invention can be used in a printer where a single photorepeptor is moved past a single imager multiple times to expose and develop multiple images of multiple colors. In addition to the electrophotographic example provided below, this invention can be used in a printer wherein the developed toner image is transferred directly from the photoreceptor to the final substrate.

Inasmuch as the art of electrophotographic printing is well known, the various processing stations employed in the FIG. 1 printing machine will be shown hereinafter schematically and their operation described briefly with reference thereto.

Turning now to FIG. 1, there is shown a color document imaging system incorporating the present invention. The color copy process can begin by inputting a computer generated color image into the image processing unit 44. Digital signals which represent the blue, green, and red density signals of the image are converted in the image processing unit into four bitmaps: yellow (Y), cyan (C), magenta (M), and black (Bk). The bitmaps represents the values of exposures for each pixel, the color components as well as the black separation. Image processing unit 44 may contain a shading correction unit, an undercolor removal unit (UCR), a masking unit, a dithering unit, a gray level processing unit, and other imaging processing sub-systems known in the art. The image processing unit 44 can store bitmap information for subsequent images or can operate in a real time mode.

The photoconductive member, preferably a belt of the type which is typically multilayered and has a substrate, a conductive layer, an optional adhesive layer, an optional hole blocking layer, a charge generating layer, a charge transport layer, and, in some embodiments, an anti-curl backing layer. It is preferred that the photoconductive imaging member employed in the present invention be infrared sensitive. This allows improved transmittance through cyan image. Belt 100 is charged by charging unit 101*a*. Raster output scanner (ROS) 20*a*, controlled by image processing unit 44, writes a first complementary color image bitmap information by selectively erasing charges on the belt 100.

The ROS 20*a* writes the image information pixel by pixel in a line screen registration mode. It should be noted that either discharged area development (DAD) can be employed in which discharged portions are developed or charged area development (CAD) can be employed in which the charged portions are developed with toner. After the electrostatic latent image has been recorded, belt 100 advances the electrostatic latent image to development station 103*a*. Liquid developer material is supplied by replenishing systems through tube 210 to development station 103*a*. An electrode may be positioned before the entrance to development station 103*a* and electrically biased to generate an electric field o as to disperse the toner particles substantially uniformly throughout the liquid carrier. The toner flows between the belt 100 and the development electrode 16*a*, of the present invention, which will be described in greater detail in connection with FIG. 2. Toner passes by electrophoresis to the electrostatic latent image to develop a toned image A roll 11*a*, turning opposite to the direction of motion of the belt 100, is positioned after the development electrode 16*a* so as to remove excess toner from the belt.

After the image is developed it is conditioned at conditioning station. Conditioning station 53*a* includes porous roller 18*a* having porous outer skin. Roller 18*a* receives the developed image on belt 100 and conditions the image by reducing fluid content while inhibiting the offset of toner particles from the image, and by compacting the toner particles of the image. Thus, an increase in percent solids is provided to the developed image, thereby improving the stability of the developed image. Preferably, the percent solids in the developed image is increased to more than about 20 percent solids. Porous roller 18*a* operates in conjunction with vacuum 19 (not shown) for removal of liquid from the roller. A roller (not shown), in pressure against the blotter roller 18*a*, may be used in conjunction with or in the place of the vacuum, to squeeze the absorbed liquid carrier from the blotter roller for deposit into a receptacle. Furthermore, the vacuum assisted liquid absorbing roller may also find useful application where the vacuum assisted liquid absorbing roller is in the form of a belt, whereby excess liquid carrier is absorbed through an absorbent foam layer. A belt used for collecting excess liquid from a region of liquid developed images is described in U.S. Pat. Nos. 4,299,902 and 4,258,115, the relevant portions of which are hereby incorporated by reference herein.

In operation, roller 18 rotates to impose against the "wet" image on belt 100. The porous body of roller 18 absorbs excess liquid from the surface of the image through the skin covering pores and perforations. Vacuum 19 located on one end of the central cavity of the roller, draws liquid that has permeated through roller 18 out through the cavity and deposits the liquid in a receptacle or some other location which will allow for either disposal or recirculation of the liquid carrier to the replenishing system of the present invention. Porous roller 18, discharged of excess liquid, continues to rotate in direction 21 to provide a continuous absorption of liquid from image on belt 100. The image on belt 100 advances to lamp 34*a* where any residual charge left on the photoconductive surface is extinguished by flooding the photoconductive surface with light from lamp 34*a*.

The development takes place for the second color, for example magenta, as follows: the developed latent image on belt 100 is recharged with charging unit 100*a*. The developed latent image is re-exposed by ROS 20*b*. ROS 20*b* superimposes a second color image bitmap's information over the previous developed latent image. At development station 103*b*, development proceeds as at station A. At image conditioning station 53*b*, roller 18*b* receives the developed image on belt 100 and conditions the image by reducing fluid content while inhibiting the departure of toner particles from the image, and by compacting the toner particles of the image. Preferably, the percent solids is more than about 20 percent, however, the percent of solids can range between 15 percent and 40 percent. The image on belt 100 advances to lamps 34*b* where any residual charge left on the photoconductive surface is extinguished by flooding the photoconductive surface with light from lamp 34.

The resultant image is a multi-layer image by virtue of the developing stations 103*a*, 103*b*, 103*c* and 103*d* having developed black, yellow, magenta, and cyan on the photoconductor prior to transfer to the final receiving member. It should be evident to one skilled in the art that the color of toner at each development station could be in a different arrangement. Transfer to the final receiving member may be accomplished directly or by use of an intermediate transfer belt.

FIG. 1 shows a printing machine design using an intermediate transfer belt. In this design, toner disposed on the photoconductor advances to the intermediate transfer station. The toned image is electrostatically transferred to the intermediate member by charging device 111. The present invention takes advantage of the dimensional stability of the intermediate member to provide a uniform image deposition stage, resulting in a controlled image transfer gap and improved image registration. Further advantages include reduced heating of the recording sheet as a result of the toner or marking particles being premelted, as well as the elimination of electrostatic transfer of charged particles to a recording sheet. Intermediate member 110 may be either a rigid roll or an endless belt having a path defined by a plurality of rollers in contact with the inner surface thereof. The multi layer image is conditioned by blotter roller 120 which receives the multi level image on intermediate member 110 and conditions the image by reducing fluid content while inhibiting the departure of toner particles from the image, and by compacting the toner particles of the image. Blotter roller 120 conditions the multi layer so that the image has a toner composition of more than 50 percent solids.

Subsequently, a multi layer image, present on the surface of the intermediate member, is advanced through image liquefaction stage. Within the image liquefaction stage, which essentially encompasses the region between when the toner particles contact the surface of member 110 and when they are transferred to recording sheet 26, the particles are transformed into a tackified or molten state by heat which is applied to member 110 internally or externally. Preferably, the tackified toner particle image is transferred, and bonded, to recording sheet 26 with limited wicking by the sheet. More specifically, the image liquefaction stage includes a heating element 32, which not only heats the external surface of the intermediate member in the region of transfuse nip 34, but because of the mass and thermal conductivity of the intermediate member, generally raises the outer wall of member 110 at a temperature sufficient to cause the toner particles present on the surface to melt. The toner particles on the surface, while softening and coalescing due to the application of heat from the exterior of member 110, maintain the position in which they were deposited on the outer surface of member 110, so as not to alter the image pattern which they represent. The member continues to advance in the direction of arrow 22 until the tackified toner particles, 30, reach transfusing stage. At transfix nip 34, the liquefied toner particles are forced, by a normal force N applied through backup pressure roll 36, into contact with the surface of recording sheet 26. Moreover, recording sheet 26 may have a previously transferred toner image present on a surface thereof as the result of a prior imaging operation, i.e. duplexing. The normal force N, produces a nip pressure which is preferably about 100 psi, and may also be applied to the recording sheet via a resilient blade or similar spring-like member uniformly biased against the outer surface of the intermediate member across its width.

As the recording sheet passes through the transfuse nip the tackified toner particles wet the surface of the recording sheet, and due to greater attractive forces between the paper and the tackified particles, as compared to the attraction between the tackified particles and the liquid-phobic surface of member 110, the tackified particles are completely transferred to the recording sheet as image marks. Furthermore, as the image marks were transferred to recording sheet 26 in a tackified state, they become permanent once they are advanced past transfix nip and allowed to cool below their melting temperature. The transfixing of tackified marking particles has the further advantage of only using heat to pre-melt the marking particles, as opposed to conventional heated-roll fusing systems which must not only heat the marking particles, but the recording substrate on which they are present.

After the developed image is transferred to intermediate member 110, residual liquid developer material may remain adhering to the photoconductive surface of belt 100. A cleaning roller 31 formed of any appropriate synthetic resin, is driven in a direction opposite to the direction of movement of belt 100 to scrub the photoconductive surface clean. It is understood, however, that a number of photoconductor cleaning means exist in the art, any of which would be suitable for use with the present invention. Any residual charge left on the photoconductive surface is extinguished by flooding the photoconductive surface with light from lamp 34*d*.

The foregoing description should be sufficient for purposes of the present application for patent to illustrate the general operation of an electrophotographic printing machine incorporating the features of the present invention. As described, an electrophotographic printing system may take the form of any of several well known devices or systems. Variations of specific electrophotographic processing subsystems or processes may be expected without affecting the operation of the present invention.

Figure 2:
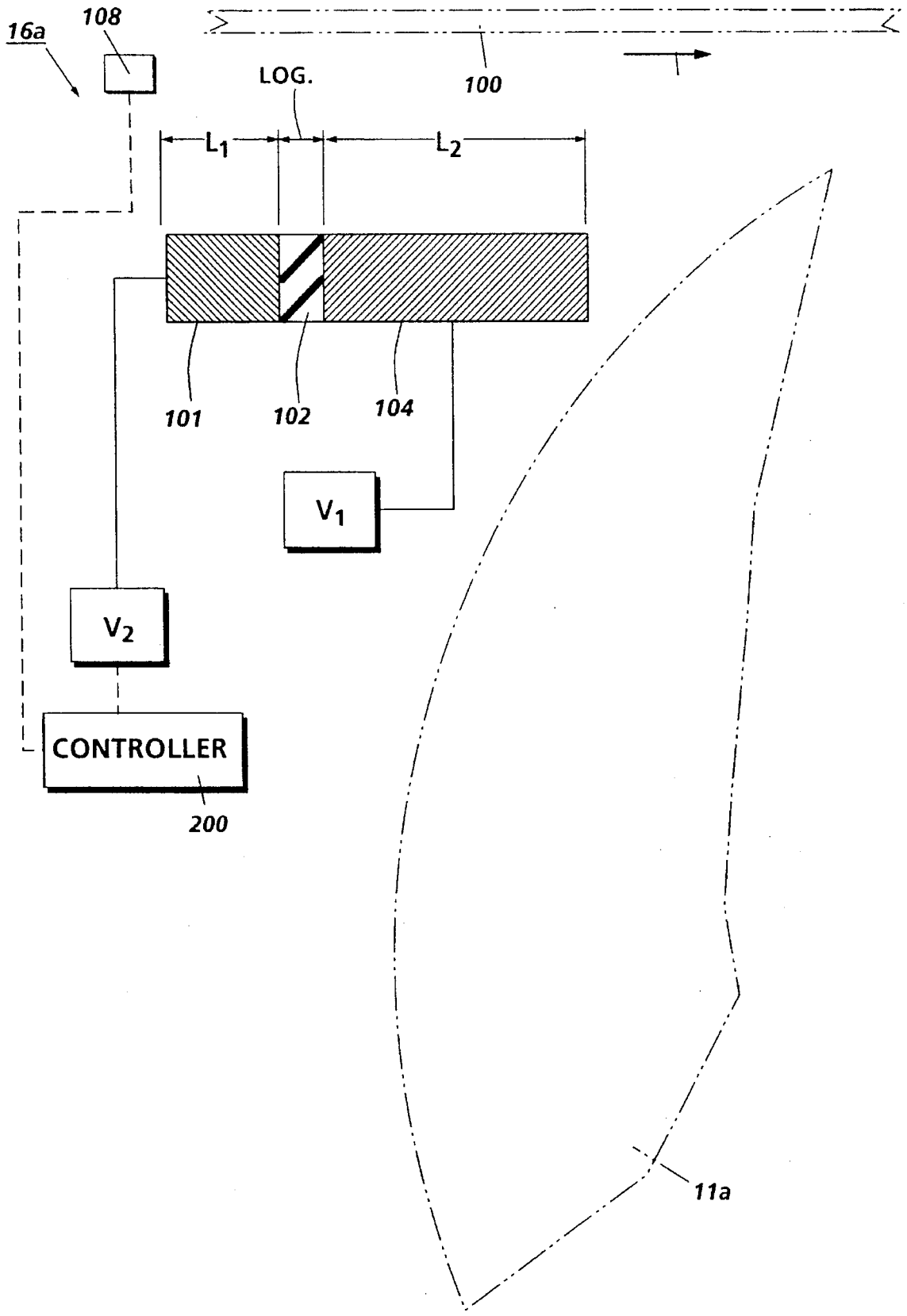
FIG. 2 is a schematic of a liquid electrostatic developer unit in accordance with the invention.

Referring to FIG. 2, electrode 16 of the present invention comprises two distinct and electrically isolated segments 101 and 104, their lengths being given by $L_1$ and $L_2$ respectively. A photoreceptor 100 bearing a latent electrostatic image is passed above these electrodes. The gap between the electrodes and the photoreceptor is filled with toner. Toner is pumped through the gap at a given rate. Preferably the rate is equal to [width×(gap thickness)×(photoreceptor linear speed)] giving slug flow. The development electrode segments are set to potentials $V_1$ and $V_2$ respectively. The voltages on the photoreceptor in the image and background areas are $V_i$ and $V_b$, respectively.

If the toner migrates with a velocity equal to its mobility times the gross electric field (that is, if the effects of space charge are ignored) the simplest case obtains. It has been found that in this case the effect of setting the two electrodes to two different potentials is the same as setting them both to the length weighted average of the two potentials. However, when space charge effects occuring in real development are taken into account the results are significantly altered.

Space charge is generated as follow: Liquid toner contains both charged toner particles and oppositely charged ions. The applied field causes the oppositely charged species to move in opposite directions. This charge separation reduces the local field. This reduction in field strength with time in the development system means that toner moves more slowly at later development times.

We have discovered that it is advantageous to apply a first development electrode bias, $V_1=V_i$, which is much larger than can be used with existing, monolithic development electrodes. This large bias rapidly moves toner away from background areas ($V_b$), but does not move toner away from (or produce space charge fields above) image areas ($V_i$). The second development electrode can then be given a much smaller bias, $V_2=V_b$. This small bias lets toner move rapidly toward image areas, but does not move toner toward background areas. The reduced times for cleaning and development (compared to a monolithic development electrode of length $L_1+L_2$) is more than compensated by the higher fields. Calculations on model systems show a 30–50% increase (over an optimized monolithic development electrode) in the mass per unit area which can be developed without background.

EXAMPLE

With a process speed of 17 inches per second, an image potential of +275 volts, a background potential of +100 volts, and a toner mobility of $-10^{-5}cm^2/V$ sec; a single development electrode 0.85 inches long would use a bias of +155 volts to clean background and develop 0.13 $mg/cm^2$ of toner in image areas. Detailed development models show that applying a $V_1$=+275 volts to a first segment 0.17 inch long and $V_2$=+100 volts to a second segment 0.68 inch long would clean background equally well and develop 0.17 $mg/cm^2$ of toner in image areas.

Electrostatic voltmeters 108 are employed which can sense the image and background voltages, and with a control system 200 which responds to voltmeter data by adjusting $V_1$ and $V_2$. This provides optimum development while avoiding background.

An important aspect of this invention is lack of turbulent mixing of the toner. The lines of fluid flow should be parallel to the photoreceptor surface, so that toner cleared from background areas by segment 101 do not flow back toward the photoreceptor above segment 104. A preferred embodiment of this invention is, therefore, a development electrode shaped to maintain a constant gap from the photoreceptor. It is preferred that there should be no physical gap between $L_1$ and $L_2$. Rather, they should be separated by an insulating layer 102, at the same distance from the photoreceptor as the elements $L_1$ and $L_2$. Materials should be chosen that will minimize the overall length, $L_1$+insulator +$L_2$, while minimizing fringe fields between $L_1$ and $L_2$.

The present invention should be especially valuable in systems where the toner mobility is low and/or the time available for toning is short. Changing to a heavier carrier fluid (e.g., from Isopar L to Isopar V) will reduce vapor pressure (from 650 ppm to 7 ppm) but increase viscosity (from 1.6 centipoise to 12.0 centipoise). Toner mobility is approximately inversely proportional to carrier viscosity, so that increasing viscosity would, without this invention, either reduce developed mass, cause background staining, or require a longer development zone. Similarly, increasing the process speed, to increase prints per minute, will either decrease development time or require a longer development zone. As the Example shows, the present invention can increase developed mass. This can compensate for reduced development time without requiring an increase in development zone length.

It is, therefore, evident that there has been provided, in accordance with the present invention, a electrode that fully satisfies the aims and advantages hereinbefore set forth. While this invention has been described in conjunction with one embodiment thereof, it is evident that many alternatives, modifications and variations will be apparent to those skilled in the art. Accordingly, it is intended to embrace all such alternatives, modification and variations as fall within the spirit and broad scope of the appended claims.

We claim:

1. An apparatus for developing a latent image recorded on a surface with liquid developer, comprising:

a housing defining a chamber for holding the liquid developer;

means for advancing the liquid developer from the chamber of the housing to a development zone;

an electrode member including a plurality of segments with each of said plurality of segments being electrically insulated from one another and an insulating layer interposed between and connecting adjacent ones of said plurality of segments, said electrode member positioned opposed from the surface defining a gap therebetween forming the development zone; and means for independently electrically biasing the segments of said electrode member.

2. The apparatus of claim 1, further comprising:

means for detecting the electrical potential of the background and image areas of the latent image; and control means, responsive to said detecting means, for adjusting said bias means.

3. The apparatus of claim 2, wherein one of said at least two segments is biased at a electrical potential substantially equal to the electrical potential of the image areas of the latent image.

4. The apparatus of claim 2, wherein one of said at least two segments is biased at a electrical potential substantially equal to the electrical potential of the background areas of the latent image.

5. The apparatus of claim 1, wherein said gap is substantially equal to the width of said insulating layer.

6. The apparatus of claim 1, wherein one of said at least two segments has a substantially longer length than the other.

7. The apparatus of claim 1, wherein said bias means applies a substantially different potential to each of said at least two segments.

8. The apparatus of claim 1, wherein said biasing means biases one of said plurality of segments to a first voltage and an adjacent one of said plurality of segments to a second voltage with the first voltage being a different voltage than the second voltage.

9. A printing machine having means for forming an electrostatic latent image on an imageable surface and an apparatus for developing the electrostatic latent image with the liquid developer, said apparatus comprising:

a housing defining a chamber for holding the liquid developer;

means for advancing the liquid developer from the chamber of the housing to a development zone;

an electrode member including a plurality of segments with each of said plurality of segments being electrically insulated from one another and an insulating layer interposed between and connecting adjacent ones of said plurality of segments, said electrode member positioned opposed from the surface defining a gap therebetween forming the development zone; and means for independently electrically biasing the segments of said electrode member.

10. The apparatus of claim 9, further comprising:

means for detecting the electrical potential of the background and image areas of the latent image; and control means, responsive to said detecting means, for adjusting said bias means.

11. The apparatus of claim 10, wherein one of said at least two segments is biased at a electrical potential substantially equal to the electrical potential of the image areas of the latent image.

12. The apparatus of claim 10, wherein one of said at least two segments is biased at a electrical potential substantially equal to the electrical potential of the background areas of the latent image.

13. The apparatus of claim 9, wherein said gap is substantially equal to the width of said insulating layer.

14. The apparatus of claim 9, wherein one of said at least two segments has a substantially longer length than the other.

15. The apparatus of claim 9, wherein said bias means applies a substantially different potential to each of said at least two segments.

16. The apparatus of claim 9, wherein said biasing means biases one of said plurality of segments to a first voltage and an adjacent one of said plurality of segments to a second voltage with the first voltage being a different voltage than the second voltage.

* * * * *